US008290404B2

(12) United States Patent
Raz

(10) Patent No.: US 8,290,404 B2
(45) Date of Patent: Oct. 16, 2012

(54) ELECTROPHOTOGRAPHIC PRINTING AND CLEANING OF THE DEVELOPER INK BEARING SURFACE

(75) Inventor: Shaul Raz, Shimshit (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 281 days.

(21) Appl. No.: 12/678,476

(22) PCT Filed: Oct. 12, 2007

(86) PCT No.: PCT/US2007/008131

§ 371 (c)(1), (2), (4) Date: Apr. 8, 2010

(87) PCT Pub. No.: WO2009/048478

PCT Pub. Date: Apr. 16, 2009

(65) Prior Publication Data

US 2010/0209156 A1 Aug. 19, 2010

(51) Int. Cl.
*G03G 15/10* (2006.01)

(52) U.S. Cl. ..... 399/237; 399/240

(58) Field of Classification Search ..... 399/57, 399/71, 120, 237–240, 248, 249
See application file for complete search history.

(56) References Cited

U.S. PATENT DOCUMENTS

| | | | | |
|---|---|---|---|---|
| 6,701,111 | B2 * | 3/2004 | Park et al. | 399/239 |
| 8,099,030 | B2 * | 1/2012 | Berg et al. | 399/265 |
| 2003/0185595 | A1 | 10/2003 | Kellie et al. | |

FOREIGN PATENT DOCUMENTS

| | | |
|---|---|---|
| EP | 1349017 | 10/2003 |
| JP | 2003195710 | 7/2003 |
| JP | 2006243047 | 9/2006 |

* cited by examiner

*Primary Examiner* — Hoan Tran

(57) ABSTRACT

An electrophotographic printing apparatus may include an image-forming member having a surface on which a latent electrostatic image can be formed and developed for transfer of the developed image to a substrate and a developer for depositing ink including charged particles onto the surface to develop the latent image. The developer may include an ink bearing surface from which ink is transferred and a cleaner for removing ink from the ink bearing surface. The developer may further include an adjustable power system generating an electric potential between the ink bearing surface and the cleaner such that charged ink particles remaining on the ink bearing surface after the transfer of ink to the image-forming member are removed from the ink bearing surface through attraction to the cleaner. A controller may adjust the power system such that a desired electric potential between the ink bearing surface and the cleaner is achieved.

17 Claims, 4 Drawing Sheets

ELECTROPHOTOGRAPHIC PRINTING AND CLEANING OF THE DEVELOPER INK BEARING SURFACE

BACKGROUND

Some electrophotographic printing devices operate by charging a surface of an image-forming drum to create a latent electrostatic image and developing the latent image by depositing charged ink particles onto the drum from an ink-bearing surface of a developer roller such that the charged particles are attracted to the desired areas of the drum. This developed image is then transferred from the drum onto a substrate, such as paper. A charged cleaner roller is provided to remove ink particles that remain on the ink-bearing surface of the developer roller after transfer of ink to the image-forming drum, thereby cleaning the ink-bearing surface of unused ink particles.

Over time, however, the conductivity of the developer roller can decrease. This has the effect of a surface of the developer roller not being charged to a target voltage. With a target voltage not being reached, the cleaning efficiency of the cleaner roller is reduced.

For rollers other than the cleaner roller, this decrease in voltage is compensated for by a color adjust procedure. However, this color adjust procedure does not compensate for the effects of the decrease in voltage on cleaning of ink from the ink-bearing surface of the developer roller.

SUMMARY

According to one aspect, there is provided a controller for electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image; the developer comprising:

an ink bearing surface from which ink is transferred to the image forming member, and a cleaner for removing ink from the ink bearing surface, an adjustable power system for generating an electric potential between the ink-bearing surface and a cleaner such that charged ink particles remaining on the ink-bearing surface after the transfer of ink to the image-forming member are removed from the ink-bearing surface through attraction to the cleaner, wherein the controller is arranged to receive measurements of electrical resistance at an interface between the ink-bearing surface and the cleaner and to adjust the power system in response to the measurements of electrical resistance to compensate for variations in electrical resistance at the interface such that a desired electric potential between the ink-bearing surface and the cleaner is achieved.

According to another aspect, there is provided a data carrier having stored thereon instructions for execution by a processor of a controller of an electrophotographic printing apparatus, the electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image; the developer comprising:

an ink bearing surface from which ink is transferred to the image forming member, and a cleaner for removing ink from the ink bearing surface, and an adjustable power system for generating an electric potential between the ink-bearing surface and a cleaner such that charged ink particles remaining on the ink-bearing surface after the transfer of ink to the image-forming member are removed from the ink-bearing surface through attraction to the cleaner, wherein, when the instructions are executed by the processor of the controller, the controller is caused to:

receive measurements of electrical resistance at an interface between the ink-bearing surface and the cleaner, and adjust the power system in response to the measurement of electrical resistance to compensate for variations in electrical resistance at the interface such that a desired electric potential between the ink-bearing surface and the cleaner is achieved.

In another aspect there is provided a developer for depositing onto the surface of an image-forming member of electrophotographic printing apparatus a layer of ink comprising charged ink particles to develop a latent image formed on the image-forming member; the developer comprising:

an ink bearing surface from which ink is transferred to the image forming member, a cleaner for removing ink from the ink-bearing surface, an adjustable power system for generating an electric potential between the ink bearing surface and the cleaner such that charged ink particles remaining on the ink bearing surface after the transfer of ink to the image-forming member are removed from the ink bearing surface through attraction to the cleaner, and a controller arranged to receive measurements of electrical resistance at an interface between the ink bearing surface and the cleaner and to adjust the power system in response to the measurements of electrical resistance to compensate for variations in electrical resistance at the interface such that a desired electric potential between the ink bearing surface and the cleaner is achieved.

In a further aspect, there is provided a controller for an electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image; the developer comprising:

an ink bearing surface from which ink is transferred to the image-forming member, a power system for generating an electric potential between the ink-bearing surface and a further member such that charged ink particles are transferred between the ink-bearing surface and the further member, wherein the controller is arranged to measure the current supplied to at least one of the ink-bearing surface and the further member and determine the resistance of an interface between the ink-bearing surface and the further member based on the measured current.

In yet another aspect, there is provided a data carrier having stored thereon instructions for execution by a processor of a controller of an electrophotographic printing apparatus, the electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image; the developer comprising:

an ink bearing surface from which ink is transferred to the image forming member, and a cleaner for removing ink from the ink bearing surface, and a power system for generating an electric potential between the ink-bearing surface and a cleaner such that charged ink particles are transferred between the ink-bearing surface and the further member, wherein, when the instructions are executed by the processor of the controller, the controller is caused to:

measure the current supplied to at least one of the ink-bearing surface and the further member and determine the resistance of an interface between the ink-bearing surface and the further member based on the measured current.

The further member may be a cleaner arranged such that charged ink particles remaining on the ink-bearing surface of the developer after the transfer of ink to the image-forming member are removed from the ink-bearing surface through attraction to the cleaner. Alternatively, the further member could be a squeegee for applying pressure to the ink on the ink-bearing surface or other device that cooperates with the ink-bearing surface.

BRIEF DESCRIPTION OF THE DRAWINGS

Embodiments will now be described, by example only, with reference to the accompanying drawing, in which.

DETAILED DESCRIPTION

Figure 1:
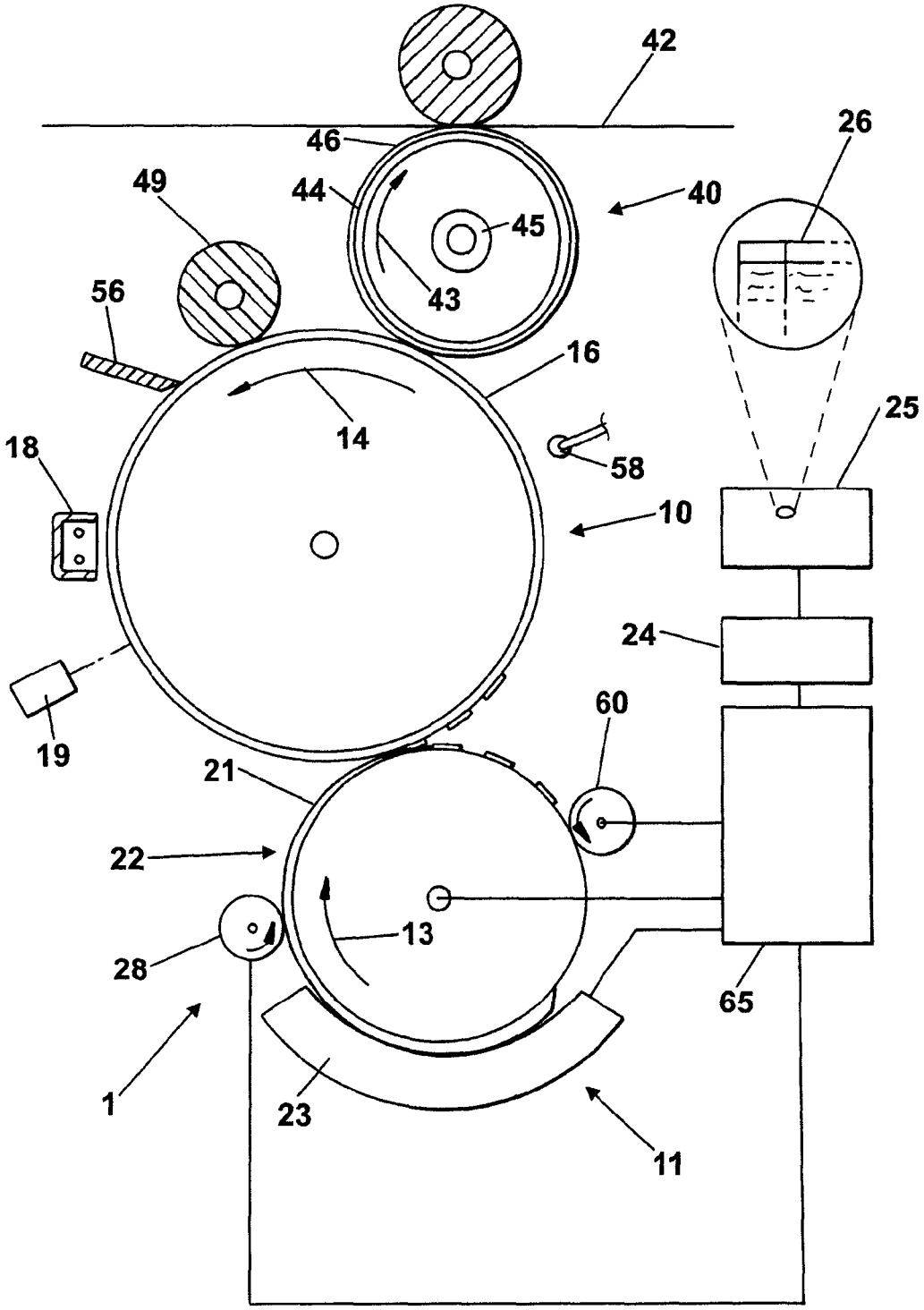
FIG. 1 is a schematic view of an embodiment of electrophotographic printing apparatus in accordance with an embodiment.
Figure 2:
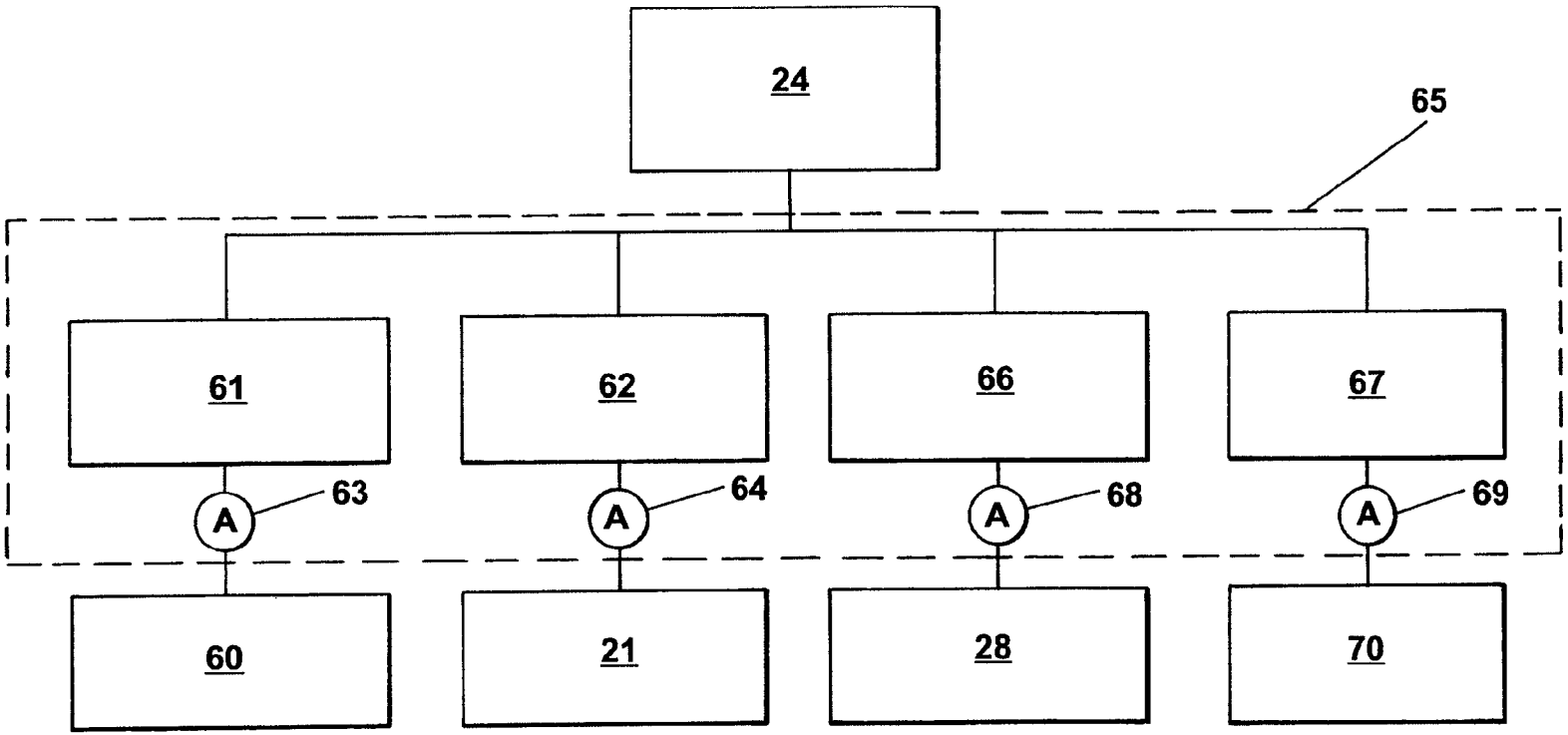
FIG. 2 is a block diagram of an adjustable power system according to one embodiment.

Referring to FIG. 1 and FIG. 2, electrophotographic printing apparatus comprises an image-forming device 1 for printing an image onto a substrate 42, such as paper, that is connectable to one or more ink tanks (not shown). The ink used in the apparatus comprises charged ink particles carried in a carrier medium, for example polymeric multi-tentacled ink particles and a liquid carrier medium, for instance an isolefin such as ISOPAR. Typically about 2% of the ink by weight is ink particles.

The image-forming device 1 comprises an image-forming member in the form of a drum 10 and a developer 11 for depositing onto a surface 16 of the drum 10 a layer of ink. In this embodiment, the developer 11 is an HP-Indigo-type BID (Binary Image Developer), however it will be understood that in other embodiments other types of developer could be used. The surface 16 is, in this example, a photoreceptor surface made of selenium, a selenium compound, an organic photoconductor or any other suitable photoconductor known in the art on which a latent electrostatic image can be formed.

During operation, drum 10 rotates, in this embodiment in an anticlockwise direction indicated by arrow 14, and a charger 18 charges photoreceptor surface 16. Charger 18 may be any type of charger known in the art, such as a corotron, a scorotron or a roller.

Continued rotation of drum 10 brings the charged photoreceptor surface 16 into alignment with an exposure device, for example a light source 19, such that the charged photoreceptor surface 16 is exposed to light emitted by the exposure device. The light source 19 may be a laser scanner (in the case of a printer) or the projection of an original (in the case of a photocopier). Light source 19 forms a desired latent image on the charged photoreceptor surface 16 by selectively discharging a portion of the photoreceptor surface 16, image portions being at a first voltage and background portions adjacent the image portions at a second voltage. The discharged portions preferably have a voltage of less than about 100 volts.

In this embodiment, developer 11 comprises a developer roller 22 and continued rotation of drum 10 brings the selectively charged photoreceptor surface 16 into engagement with an ink-bearing surface 21 of a developer roller 22. It will be understood that even though only one developer 11 is shown in the drawing, the apparatus may comprise more than one developer. For example, in one embodiment, the apparatus comprises four developers, one for each ink color, black, cyan, magenta and yellow.

The ink bearing surface 21 is charged to an electric potential by power supply 62 (see FIG. 2) of power supply system 65. Developer roller 22 rotates in an opposite direction to that of drum 10, in this embodiment, clockwise as shown by arrow 13, and at a set angular velocity. Developer roller 22 is most preferably urged against drum 10.

An applicator assembly 23 of developer 11 coats surface 21 with a thin layer of ink. The applicator assembly 23 is supplied with ink from an ink tank (not shown). The applicator assembly 23 comprises one or more electrodes 70 (see FIG. 2) for charging ink as it is deposited onto the ink-bearing surface 21 of developer roller 22. The one or more electrodes 70 are charged to an electric potential by power supply 67 (see FIG. 2) of power system 65.

As the developer roller 22 rotates the ink on ink-bearing surface 21 comes into contact with squeegee roller 28 that applies pressure to ink on the ink-bearing surface 21 causing the ink to be spread evenly across surface 21 and charges the ink on the surface 21. The squeegee roller 29 is preferably held at an electric potential by power supply 66 of power system 65.

On further rotation of developer roller 22, surface 21 bearing the layer of ink engages with photoreceptor surface 16 of drum 10, the difference in potential between the surface 21 and surface 16 causing selective transfer of the layer of ink particles to surface 16, thereby developing the latent image. Depending on the choice of ink charge polarity and the use of a "write-white" or "write-black" system, as known in the art, the layer of ink particles will be selectively attracted to either the charged or discharged areas of surface 16, and the remaining portions of the ink layer will continue to adhere to surface 21.

A cleaning assembly of the developer 11 removes unused ink (ink that has not been transferred to surface 16 of drum 10) from the ink-bearing surface 21. This cleaning assembly comprises a conductive cleaning roller 60 that can be charged by a further power supply 61 (see FIG. 2) of power system 65 under the control of controller 24. To clean ink from the surface 21, roller 60 is charged to a predetermined voltage (determined by controller 24 in the manner described below) such that the ink will be attracted to the cleaner roller 60 cleaning the ink-bearing surface 21 of charged ink particles. The unused ink removed by cleaning roller 60 is delivered back to the ink tank along a path (not shown).

The controller 24 comprises a microprocessor that executes instructions in the form of a computer program stored in memory 25. These instructions cause the controller 24 to control the power supply 61 to supply a predetermined voltage to cleaning roller 60 based on a measured value of electrical resistance of the nip (interface) between roller 22 and cleaning roller 60 such that a desired electric potential is achieved between rollers 22, 60. In this embodiment, controller 24 determines the predetermined voltage via a look up table 26 stored in memory 25, the look-up table 26 comprising suitable values of voltage that achieve the desired electric potential for certain values of nip resistance.

Figure 3:
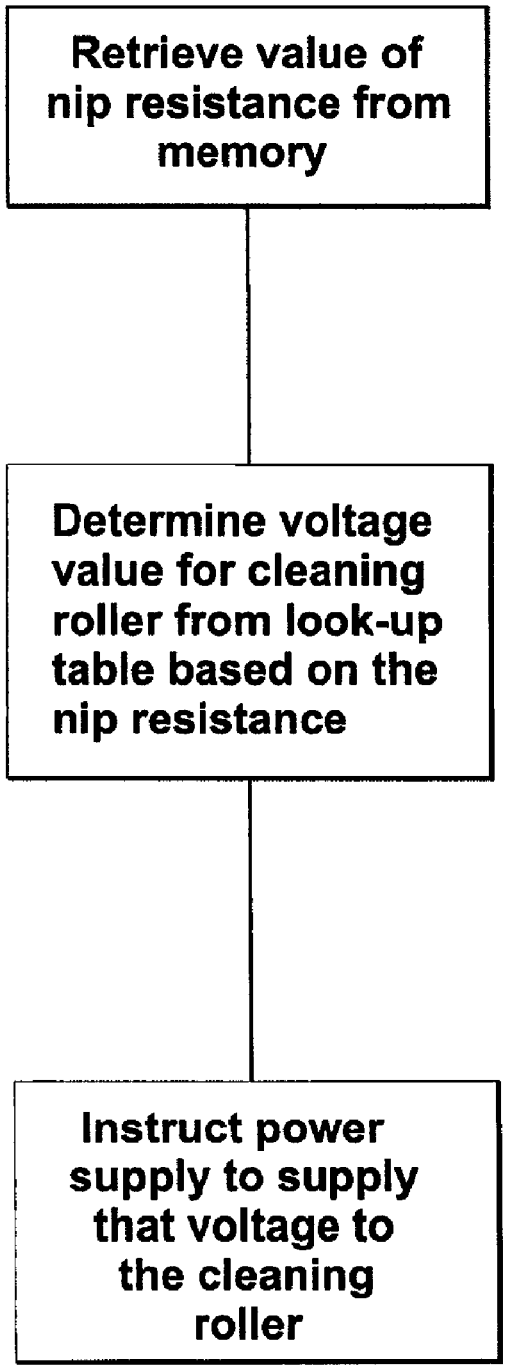
FIG. 3 is a flowchart showing the method for adjusting the voltage supplied to a cleaning roller as carried out by electrophotographic printing apparatus.

During operation of the apparatus, memory 25 is regularly up-dated with a value for the nip resistance between rollers 22 and 60. Referring to FIG. 3, when, during a printing operation, developer roller 22 is used to develop a latent image on drum 10, the controller 24 retrieves the current value for nip resistance from memory 25 and determines from look-up table 26 the suitable voltage. The controller 24 then instructs power supply 61 to supply this predetermined voltage to roller 60. In this way, the voltage supplied to roller 60 is adjusted to compensate for variations in nip resistance.

Increasing the cleaning roller voltage as the nip resistance increases, reduces deterioration of print quality as a suitable cleaning voltage is achieved. Furthermore, it reduces or even eliminates undesirable print quality issues such as stains and ghost signals.

In one embodiment, the look-up table 26 comprises a series of threshold values for nip resistance, wherein if the nip resistance increases above a threshold value, a greater voltage is used. In this way, the voltage is increased in a series of steps as the nip resistance increases.

A lamp 58 removes any residual charge on drum 10 before transfer of the developer image to a substrate.

The developed image formed on the drum 10 may be directly transferred to a desired substrate from the image forming surface 16 in a manner well known in the art. Alternatively, as shown in FIG. 1, there may be provided an intermediate transfer member 40, which may be a drum 46 or belt and which is in operative engagement with photoreceptor surface 16 of drum 10 bearing the developed image. Intermediate transfer member 40 rotates in a direction opposite to that of photoreceptor surface 16, as shown by arrow 43, providing substantially zero relative motion between their respective surfaces at the point of image transfer.

Intermediate transfer member 40 is operative for receiving the ink image from photoreceptor surface 16 and for transferring the ink image to a final substrate 42, such as paper. Disposed internally of intermediate transfer member 40, there may be provided a heater 45 to heat intermediate transfer member 40. Transfer of the image to intermediate transfer member 40 is preferably aided by providing electrification of intermediate transfer member 40 to provide an electric field between intermediate transfer member 40 and the image areas of photoreceptor surface 16. Intermediate transfer member 40 preferably has a conducting layer 44 underlying an elastomer layer 46, which is preferably a slightly conductive resilient polymeric layer.

Following the transfer of the ink image to substrate 42 or to intermediate transfer member 40, the rotating photoreceptor surface 16 encounters and engages a cleaning station 49 which cleans most or substantially all charged particles remaining on the surface 16.

In this embodiment, a scraper 56 completes the removal of any residual ink, ink particles, carrier liquid, which may not have been removed by cleaning station 49.

Referring to FIG. 2, the adjustable power system 65 comprises separate power supplies 61, 62, 66, 67 for charging the cleaner roller 60, ink-bearing surface 21 of developer roller 22, squeegee 28 and one or more electrodes 70 of the applicator assembly 23. As explained above, power supply 61 is adjustable to alter the electric potential applied to the cleaner roller 60.

Associated with each power supply 61, 62, 66 and 67 is an ammeter 63, 64, 68, 69 (or other current measuring device) for measuring the current supplied to each device 60, 21, 28 and 70. The currents supplied to each device can indicate when a device is faulty or of a need to alter the number of charged particles in the ink.

Figure 4:
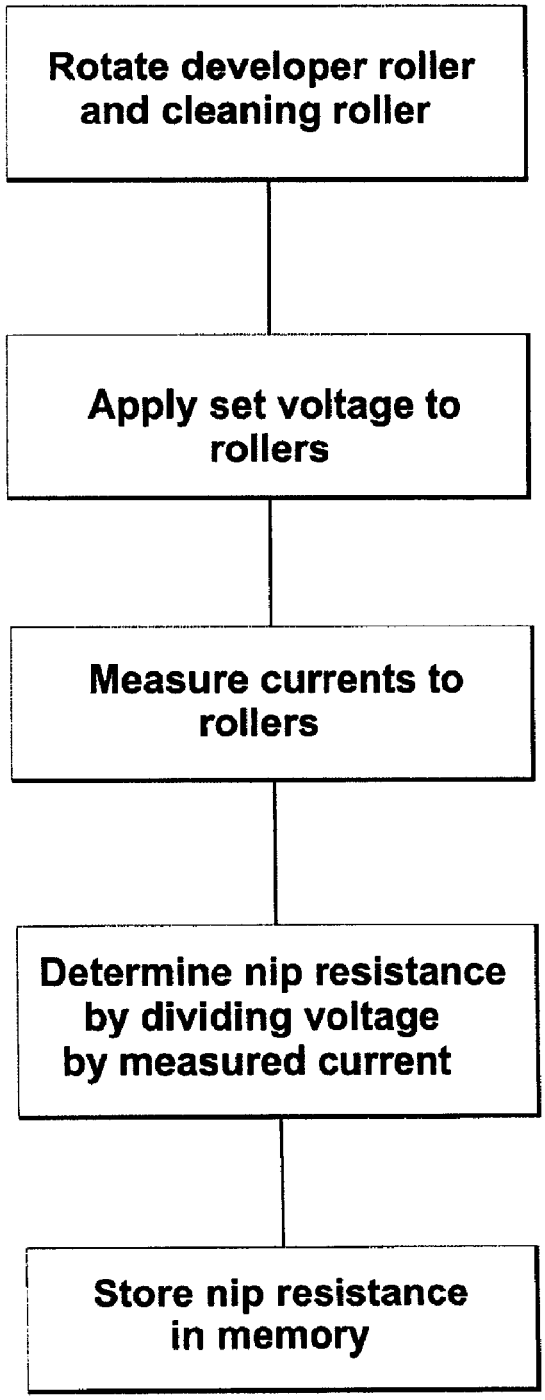
FIG. 4 is a flowchart showing the method for measuring nip resistance as carried out by electrophotographic printing apparatus.

The apparatus is arranged to measure the nip resistance between at least the developer roller 22 and cleaning roller 60 periodically, typically daily prior to a dry cleaning procedure. This measurement procedure will now be described with reference to FIGS. 1 and 4.

The nip resistance is measured by setting power supplies 62 and 61 to charge the developer roller 22 and cleaning roller 60 so as to produce a predetermined potential difference between the rollers 22 and 60, typically 300V. The other two power supplies 66 and 67 are held at the same voltage as power supply 62 so no potential difference and no current flow will take place between the developer roller 22 and squeegee roller 28 and applicator assembly 23. Both rollers 22 and 60 are rotated at a set velocity, such that the relative velocity is zero. The typical velocity is that at which the developer roller 22 rotates during printing.

Ammeters 63 and 64 measure the current that is supplied to the developer roller 22 and roller 60 from power supplies 62 and 61. These values of current are fed into controller 24, which determines the nip resistance by dividing the predetermined voltage difference by either one of the measured currents (the current measurements being equal and opposite). This value of nip resistance is stored in memory 25 to be used by controller 24 to determine the voltage for the cleaning roller 60 during a printing operation. In this way, the apparatus can determine nip resistance under dynamic conditions (i.e. without having to disassemble the printing apparatus).

The nip resistance measurement is performed in the absence of ink on drum 11.

In one embodiment, the nip resistance between the squeegee 28 and the ink-bearing surface 21 of the developer roller 22 is also measured under dynamic conditions.

In one embodiment, nip resistance between the developer roller 22 and cleaning roller 60 is used to determine the extent that the developer roller 22 has degraded and whether a replacement developer roller is required. Accordingly, the process of measuring nip resistance could be used in an apparatus in addition to or separate from the control of cleaning roller voltage. Equally, the cleaning roller voltage is controlled in response to a measurement of nip resistance, but this does not have to be carried out as described above. For example, the nip resistance may be measured manually and input into the control unit 24 of the apparatus rather than being measured automatically by the apparatus.

Furthermore, it will be understood that direct measurements of resistance cannot be made and references herein to "measurements of electrical resistance" means determining electrical resistance from measuring values, such as current and/or voltage. In the above-described embodiment, a constant voltage supply is provided and the current is measured. However, it will be understood that in another embodiment, a constant current supply is provided and the voltage is measured.

Power system 65 has been described as comprising separate power supplies 61, 62, 66 and 67, however in another embodiment one or more of the power supplies could act as a common source of power to one or more of the devices. For example, the squeegee and electrode could have a common power supply, any variations in the desired electric potential being achieved by selecting appropriate resistance values of the circuit. It will be understood that the power system 65 could comprise any arrangement that can generate an electric potential between the cleaner roller 60 (or/and other roller, such as the squeegee) and the ink-bearing surface 21 of developer roller 22 and can be adjusted to compensate for changes in the nip resistance between the cleaner roller 60 and ink-bearing surface 21.

The invention claimed is:

1. Electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image; the developer comprising:

an ink bearing surface from which ink is transferred to the image forming member, a cleaner for removing ink from the ink bearing surface, an adjustable power system for generating an electric potential between the ink bearing surface and the cleaner such that charged ink particles remaining on the ink bearing surface after the transfer of ink to the image-forming member are removed from the ink bearing surface through attraction to the cleaner, and a controller arranged to receive measurements of electrical resistance at an interface between the ink bearing surface and the cleaner and to adjust the power system in response to the measurements of electrical resistance to compensate for variations in electrical resistance at the interface such that a desired electric potential between the ink bearing surface and the cleaner is achieved.

2. Electrophotographic printing apparatus according to claim 1, wherein the controller is arranged to increase the voltage applied by the power system to the cleaner in response to variations in electrical resistance.

3. Electrophotographic printing apparatus according to claim 2, wherein the controller is arranged to increase the voltage applied to the cleaner by the power system proportionally with increases in the measured value of electrical resistance.

4. Electrophotographic printing apparatus according to claim 2, wherein the controller is arranged to increase the voltage applied to the cleaner by the power system when the measured electrical resistance reaches predetermined threshold values, the voltage being maintained constant for increases in electrical resistance between these threshold values.

5. Electrophotographic printing apparatus according to claim 3 or claim 4, wherein the controller comprises memory in which is stored a look-up table comprising values of voltages for values of electrical resistance, the controller arranged to determine the voltage to be applied to the cleaner by the power system from the look-up table.

6. Electrophotographic printing apparatus according to claim 1, wherein the controller is arranged to measure the electrical resistance at an interface between the ink-bearing surface and the cleaner.

7. Electrophotographic printing apparatus according to claim 6, wherein the controller comprises at least one current measurement device that measures the current supplied to the cleaner and/or ink bearing surface and the controller is arranged to determine the electrical resistance at the interface.

8. Electrophotographic printing apparatus according to claim 7, wherein the controller measures the electrical resistance at the interface by causing relative movement between the ink bearing surface and cleaner, at a set speed that is used during printing of an image, controlling the power system to apply voltages to the ink bearing surface and cleaner to achieve a predetermined electrical potential between the ink bearing surface and cleaner, measuring current supplied to one of or both the ink bearing surface and cleaner and dividing the predetermined electrical potential by the measured current to determine the electrical resistance of the interface.

9. A method of calibrating electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image; the developer comprising:

an ink bearing surface from which ink is transferred to the image forming member, a cleaner for removing ink from the ink bearing surface, an adjustable power system for generating an electric potential between the ink-bearing surface and the cleaner such that charged ink particles remaining on a ink-bearing surface after the transfer of ink to the image-forming member are removed from the ink-bearing surface through attraction to the cleaner, the method comprising:

measuring electrical resistance at an interface between the ink-bearing surface and the cleaner, and adjusting the power system in response to the measurement of electrical resistance to compensate for variations in electrical resistance at the interface such that a desired electric potential between the ink-bearing surface and the cleaner is achieved.

10. A method according to claim 9 comprising increasing the voltage applied by the power system to the cleaner in response to variations in electrical resistance.

11. A method according to claim 10, comprising increasing the voltage applied by the power system proportionally with increases in the measured value of electrical resistance.

12. A method according to claim 10, comprising increasing the voltage applied by the power system when the measured electrical resistance reaches predetermined threshold values and maintaining the voltage constant for increases in electrical resistance between these threshold values.

13. A method according to claim 12, wherein measuring the electrical resistance comprises measuring the current supplied to the cleaner and/or ink-bearing surface and determining the electrical resistance from the measured current.

14. A method according to claim 13, comprising measuring the electrical resistance at the interface by causing relative movement between the ink-bearing surface and cleaner, at a set speed that is used during printing of an image, applying voltages to the ink-bearing surface and cleaner to achieve a set electrical potential between the ink-bearing surface and cleaner, measuring current supplied to one of or both the ink-bearing surface and cleaner and dividing the predetermined electrical potential by the measured current to determine the electrical resistance of the interface.

15. Electrophotographic printing apparatus comprising:

an image-forming member having a surface on which a latent electrostatic image can be formed and developed for transfer of the developed image to a substrate, a developer for depositing onto the surface of the image-forming member a layer of ink comprising charged ink particles to develop the latent image; the developer comprising:

an ink bearing surface from which ink is transferred to the image forming member, a power system for generating an electric potential between the ink-bearing surface and a further member such that charged ink particles are transferred between the ink-bearing surface and the further member, and a controller arranged to measure the current supplied to at least one of the ink-bearing surface and the further member and determine the resistance of an interface between the ink-bearing surface and the further member based on the measured current.

16. Electrophotographic printing apparatus according to claim 15, wherein the further member is a cleaner arranged such that charged ink particles remaining on the ink-bearing surface after the transfer of ink to the image-forming member are removed from the ink-bearing surface through attraction to the cleaner.

17. Electrophotographic printing apparatus according to claim 15, wherein the controller measures the electrical resistance at the interface by causing relative movement between the ink-bearing surface and further member, at a speed that is used during printing of an image, causing the power system to apply voltages to the ink-bearing surface and further member to achieve a predetermined electrical potential between the ink-bearing surface and further member, measuring current supplied to one of or both the ink-bearing surface and further member and dividing the predetermined electrical potential by the measured current to determine the electrical resistance of the interface.

* * * * *

UNITED STATES PATENT AND TRADEMARK OFFICE

CERTIFICATE OF CORRECTION

PATENT NO. : 8,290,404 B2
APPLICATION NO. : 12/678476
DATED : October 16, 2012
INVENTOR(S) : Shaul Raz It is certified that error appears in the above-identified patent and that said Letters Patent is hereby corrected as shown below:

On the title page, in item (86), PCT No., in column 1, line 1, delete "PCT/US2007/008131" and insert -- PCT/US2007/0081316 --, therefor.

Signed and Sealed this
Twelfth Day of February, 2013

Teresa Stanek Rea
*Acting Director of the United States Patent and Trademark Office*